US008086146B2

(12) United States Patent
Uno et al.

(10) Patent No.: US 8,086,146 B2
(45) Date of Patent: Dec. 27, 2011

(54) IMAGE FORMING METHOD AND APPARATUS FOR EFFECTIVELY SUPPLYING DEVELOPER

(75) Inventors: Mugijirou Uno, Isehara (JP); Kiyonori Tsuda, Yokohama (JP); Hiroyuki Okaji, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 822 days.

(21) Appl. No.: 11/558,321

(22) Filed: Nov. 9, 2006

(65) Prior Publication Data

US 2007/0116494 A1 May 24, 2007

(30) Foreign Application Priority Data

Nov. 9, 2005 (JP) ..... 2005-324361
Jan. 5, 2006 (JP) ..... 2006-000684

(51) Int. Cl.
*G03G 15/08* (2006.01)

(52) U.S. Cl. ..... 399/258; 399/259; 399/262; 222/92

(58) Field of Classification Search ..... 399/253, 399/254, 258, 259, 262; 222/92
See application file for complete search history.

(56) References Cited

U.S. PATENT DOCUMENTS 4,614,165 A 9/1986 Folkins et al.
4,945,956 A * 8/1990 Bueyuekgueclue et al. .... 141/67
5,258,253 A 11/1993 Fukumoto et al.
5,740,507 A * 4/1998 Ichikawa et al. ..... 399/262
5,953,567 A 9/1999 Muramatsu et al.
5,979,326 A * 11/1999 Ohinata ..... 101/494
6,507,720 B2 1/2003 Kabumoto et al.
6,608,983 B2 * 8/2003 Terazawa et al. ..... 399/258
6,678,492 B1 * 1/2004 Terazawa et al. ..... 399/258
6,819,897 B2 11/2004 Kita
6,882,817 B2 4/2005 Kita
7,039,346 B2 * 5/2006 Terazawa et al. ..... 399/258
7,123,865 B2 10/2006 Kita
7,277,665 B2 * 10/2007 Terazawa et al. ..... 399/258
7,650,103 B2 * 1/2010 Isomura ..... 399/262
7,801,467 B2 * 9/2010 Uno et al. ..... 399/258
7,925,190 B2 * 4/2011 Matsumoto et al. ..... 399/258
2001/0041083 A1 11/2001 Terazawa et al.

(Continued)

FOREIGN PATENT DOCUMENTS

EP 0 736 813 B1 10/1996

(Continued)

OTHER PUBLICATIONS

U.S. Appl. No. 12/138,802, filed Jun. 13, 2008, Uno et al.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A developer container that contains a two-component developer including a carrier and toner includes a developer containing portion configured to include a plurality of surfaces and to accommodate the two-component developer and a cap configured to communicate to a suction pump so that the two-component developer is sucked by the suction pump and is conveyed to a developing unit. The developer containing portion is configured to include an internal space having at least 12% of an air space measured after the two-component developer is packed in the developer containing portion and left still for at least 24 hours.

13 Claims, 6 Drawing Sheets

U.S. PATENT DOCUMENTS

| | | | | |
|---|---|---|---|---|
| 2002/0106221 | A1 | 8/2002 | Muramatsu et al. | |
| 2003/0118375 | A1* | 6/2003 | Litwiller | 399/262 |
| 2003/0235436 | A1 | 12/2003 | Kasahara et al. | |
| 2004/0131392 | A1 | 7/2004 | Matsumoto et al. | |
| 2004/0191666 | A1 | 9/2004 | Kamada et al. | |
| 2004/0217127 | A1* | 11/2004 | Kimura et al. | 222/92 |
| 2005/0089347 | A1* | 4/2005 | Muramatsu et al. | 399/262 |
| 2005/0117936 | A1* | 6/2005 | Takami | 399/258 |
| 2005/0226655 | A1 | 10/2005 | Katsuyama et al. | |
| 2006/0002743 | A1 | 1/2006 | Katsuyama et al. | |
| 2006/0029431 | A1* | 2/2006 | Tanaka et al. | 399/254 |
| 2006/0099012 | A1 | 5/2006 | Kita et al. | |
| 2006/0204282 | A1* | 9/2006 | Yoshida et al. | 399/254 |
| 2006/0263116 | A1* | 11/2006 | Katsuyama | 399/258 |
| 2008/0063434 | A1* | 3/2008 | Uno et al. | 399/260 |
| 2008/0213684 | A1* | 9/2008 | Nagayama et al. | 430/109.3 |
| 2011/0110689 | A1* | 5/2011 | Hirayama et al. | 399/258 |

FOREIGN PATENT DOCUMENTS

| | | | |
|---|---|---|---|
| EP | 0 967 076 | B1 | 12/1999 |
| EP | 1 335 252 | B1 | 8/2003 |
| EP | 1785780 | A2 * | 5/2007 |
| JP | 53-022747 | | 3/1978 |
| JP | 62-218974 | | 9/1987 |
| JP | 09-054454 | | 2/1997 |
| JP | 9-134034 | | 5/1997 |
| JP | 11-272075 | | 10/1999 |
| JP | 2000-056485 | | 2/2000 |
| JP | 2004-029306 | | 1/2004 |
| JP | 2004-78252 | | 3/2004 |
| JP | 2004-191546 | | 7/2004 |
| JP | 2004-191882 | | 7/2004 |
| JP | 2004-287073 | | 10/2004 |
| JP | 2004-287269 | | 10/2004 |
| JP | 2004-333514 | | 11/2004 |
| JP | 2005-141271 | | 6/2005 |
| JP | 2005-222079 | | 8/2005 |
| JP | 2005-258458 | | 9/2005 |
| WO | WO 2005/098548 | A1 | 10/2005 |

OTHER PUBLICATIONS

U.S. Appl. No. 12/166,951, filed Jul. 2, 2008, Miyamoto et al.
U.S. Appl. No. 12/114,164, filed May 2, 2008, Matsumoto et al.
U.S. Appl. No. 11/971,580, filed Jan. 9, 2008, Kita et al.
U.S. Appl. No. 12/019,984, filed Jan. 25, 2008, Tsuda et al.
U.S. Appl. No. 12/020,172, filed Jan. 25, 2008, Tsuda et al.
U.S. Appl. No. 12/042,848, filed Mar. 5, 2008, Kita et al.
U.S. Appl. No. 12/059,392, filed Mar. 31, 2008, Tateyama et al.
U.S. Appl. No. 11/836,298, filed Aug. 9, 2007, Tsuda et al.
U.S. Appl. No. 11/842,659, filed Aug. 21, 2007, Uno et al.
U.S. Appl. No. 12/020,713, filed Jan. 28, 2008, Matsumoto et al.
U.S. Appl. No. 12/238,815, Sep. 26, 2008, Utsunomiya et al.
U.S. Appl. No. 12/253,538, filed Oct. 17, 2008, Uno et al.
U.S. Appl. No. 12/250,046, filed Oct. 13, 2008, Tsuda.
U.S. Appl. No. 12/246,027, Oct. 6, 2008, Uno et al.
U.S. Appl. No. 11/853,490, filed Sep. 11, 2007, Miyamoto et al.
Office Action issued Mar. 8, 2011 in Japanese Patent Application No. 2005-324361.
Japanese Office Action issued May 17, 2011, in Japanese Patent Application No. 2006-000684 filed Jan. 5, 2006.

* cited by examiner

IMAGE FORMING METHOD AND APPARATUS FOR EFFECTIVELY SUPPLYING DEVELOPER

CROSS REFERENCE TO RELATED APPLICATIONS

The present application claims priority to Japanese patent applications no. 2005-324361, filed in the Japan Patent Office on Nov. 9, 2005, and no. 2006-000684, filed in the Japan Patent Office on Jan. 5, 2006, the disclosures of which are incorporated by reference herein in their entirety.

BACKGROUND OF THE INVENTION

1. Field of the Invention

The present invention relates to an image forming method and apparatus for effectively supplying developer, and more particularly relates to a developer container containing two-component developer, an image forming apparatus including the developer container to supply the two-component developer to a developing unit, and methods of packing the two-component developer and of determining a condition of the two-component developer packed in the developer container.

2. Discussion of the Related Art

A two-component developer includes toner and carriers and is generally contained in a developer container. As an image forming operation is repeated, a coated layer on a surface of the carrier in the developer container may be damaged by abrasion due to aging and/or by adhesion of a toner resin and additives thereto. Such a carrier cannot effectively charge toner and may gradually deteriorate, which can cause fogging on the background of an image and toner scattering to an image when the condition of the carrier falls below an acceptable level. Therefore, a technical representative visits a user on a regular basis to replace the developer accommodated in a background image forming apparatus. Accordingly, a unit price of a copy has increased to compensate for the large amount of maintenance costs.

A background image forming apparatus has employed a process that can regularly perform automatic replenishment and discharging of carriers as well as toner. The above-described process is one type of a process known as "trickle development." The above-described process stores and supplies carrier and toner separately, which requires space for respective storing units and respective replenishing mechanisms for both toner and carrier and may increase the cost and size of the entire image forming apparatus.

A different background image forming apparatus includes spiral containers with respective opening parts for replenishment for discharging stored developers and have a projection streak part that is provided so as to project inward from at least a container internal wall and be spiral toward the opening part for replenishment. In such a device a developer receiving device is replenished with a developer carried by the projection streak part as the spiral containers rotate, and the developer contains a 1 pt. wt. carrier and a 1 to 30 pts. wt. toner, the true specific gravity of the carrier being 2.5 to 4.5.

Accordingly, a developer replenishing developing unit serving as a replenishing mechanism may not provide toner scattering even in use for a long period of time and can maintain a stable amount of toner charge in the developing unit and provide high image density uniformity and gradation, and thereby high quality image without fogging thereon can be obtained.

Further, a different background image forming apparatus includes a developer supplying kit that serves as a replenishing mechanism and is detachably attached to the background image forming apparatus. The developer supplying kit includes a developer storing part for storing the developer in the inside thereof, a discharging opening mounted on the developer storing part for discharging the developer, and an agitating member arranged rotatably in the inside of the developer storing part. The agitating member includes a shaft part for rotatably holding the agitating member on the developer supplying kit, and an agitating blade formed on a flexible member and attached to the shaft part. The agitating blade slides and scratches the inner wall face of the developer supplying kit. In the developer supplying kit for agitating and conveying the developer, the developer includes a mixture of toner and substantially spherical spacer particles. An average particle diameter (D50) of the spacer particles is larger than a weighted average particle diameter (D4) of the toner.

With the above-described structure, the occurrence of coarse particles caused by image inferiority when the developer is transported to a developing unit may be suppressed.

The above-described two background image forming apparatuses have employed a method in which a developer or a carrier is added to toner accommodated in a bottle cartridge for replenishment so as to supply the toner while rotating the bottle cartridge.

FIG. 1 shows a schematic structure of a bottle cartridge 33 employed in the above-described background image forming apparatuses in which the above-described method is used.

In FIG. 1, the bottle cartridge 33 includes a cylindrical bottle 42 having a containing portion therein and a cap 34. The containing portion of the cylindrical bottle 42 includes a spiral protrusion or spiral groove on an internal surface thereof and contains toner therein to be supplied to a developing unit 39.

When the bottle cartridge 33 is connected to a replenishing mechanism (not shown), a bottom surface of the cylindrical bottle 42, which is an end portion opposite to the cap 34, and a bottle drive motor 38 are engaged with each other. At the same time, the cap 34 is fixedly attached to the replenishing mechanism. When a lever 37 mounted on the cap 34 is pulled down, an opening (not shown) of the cylindrical bottle 42 is opened. Further, when the bottom surface of the cylindrical bottle 42 and a drive shaft (not shown) of the bottle drive motor 38 are engaged, a shutter pin 41*a* mounted on a shutter 41 is guided in an upward direction along a slope of a protruding portion 40 of the developing unit 39. Thereby, the shutter 41 opens to open an outlet 36.

Generally, when a mixture of toner and carrier is supplied from a rotary bottle such as the cylindrical bottle 42 having a spiral groove on an internal surface thereof, the toner has been conveyed to an outlet of the cylindrical bottle 42 while being agitated in the cylindrical bottle 42.

However, when the above-described bottle cartridge 23 includes a resin material or other material having rigidity, toner and carrier contained in the bottle cartridge 23 may be separated so as to supply the carrier before or after the toner. Since in such a case developer cannot have a stable amount of toner, the toner density in the developing unit cannot be controlled stably and, as a result, defective images may be reproduced.

Specifically, the carrier having a greater specific gravity may subdue or sink to a lower portion of the internal surface of the cylindrical bottle 42 while being agitated. Since the carrier is held in contact with or located close to the internal surface, the drive force of the cylindrical bottle 42 can be transmitted to the carrier easier than to the toner gathering in a center portion of the cylindrical bottle 42, and thereby the carrier is conveyed to the outlet of the cylindrical bottle 42 along the spiral groove and selectively supplied before the toner. As a result, the toner density control in the developing unit 39 becomes unstable, thereby causing production of defective images.

Further, as the bottle is rotated, the toner separated from the carrier may be coagulated in the bottle, which can also result in defective images having white spots.

Since the above-described background image forming apparatuses use toner and carrier, an increase of costs cannot be avoided.

Further, since a large amount of carriers is replenished and used, the cost for consumables including toner and carrier may increase and the used carrier may further contaminate the environment.

On the other hand, when a suction type toner supplying unit is employed, toner is filled to a container including a flexible material such as a vinyl and is sucked by a pump to be supplied to a developing unit. Such a suction type toner supplying unit cannot stably supply the toner to the developing unit when the toner is fully packed in the container. In other words, the container is required to include an air space to smoothly supply the toner therefrom. However, when the dimension of that air space becomes greater, the amount of toner packed may be smaller or the dimension of the image forming apparatus may be greater.

SUMMARY OF THE INVENTION

Exemplary aspects of the present invention have been made in view of the above-described circumstances.

Exemplary aspects of the present invention provide a developer container that can efficiently supply developer.

Other exemplary aspects of the present invention provide an image forming apparatus that can include the above-described developer container device therein.

Other exemplary aspects of the present invention provide a method of packing a two-component developer in use for the above-described developer container.

Other exemplary aspects of the present invention provide a method of determining a condition of the two-component developer packed in the above-described developer container.

In one exemplary embodiment, a developer container containing a two-component developer including a carrier and toner includes a developer containing portion configured to include a plurality of surfaces and to accommodate the two-component developer, and a cap configured to communicate to a suction pump so that the two-component developer is sucked by the suction pump and is conveyed to a developing unit.

The developer containing portion may be configured to include at least one surface formed with a flexible material.

The developer containing portion may be configured to include an internal space having at least 12% of an air space measured after the two-component developer is packed in the developer containing portion and left still for at least 24 hours.

A weight ratio of the carrier to the two-component developer may be in a range from approximately 3 wt % to approximately 20 wt %.

The two-component developer in the developer containing portion may be electrically charged to have an amount of toner charge arranged to be in a predetermined range.

The amount of toner charge to the two-component developer in the developer container may be arranged to be equal to or greater than a different amount of toner charge obtained when the carrier is mixed with a preexisting developer previously accommodated in the developing unit.

At least a portion of the amount of toner charge to the two-component developer in the developer container may be arranged to be frictionally charged while the two-component developer is being packed into the developer containing portion.

The two-component developer may include an accelerated coagulation equal to or less than 10%.

The toner may include a lubricant having a weight ratio to the toner in a range from approximately 0.3 wt % to approximately 3.0 wt %.

The flexible material may have a moisture vapor transmission rate of 1.0 $g/m^2$ or smaller per 24 hours.

Further, in one exemplary embodiment, an image forming apparatus includes a developing unit configured to develop a toner image with a two-component developer and to receive and discharge the two-component developer, a suction pump configured to suck the two-component developer to convey to the developing unit, a developer conveying path, a portion of which includes the suction pump, configured to convey the developer therethrough to the developing unit, and a developer container configured to contain the two-component developer including a carrier and toner. The developer container includes a developer containing portion configured to include a plurality of surfaces and to accommodate the two-component developer and a cap configured to communicate to the suction pump so that the two-component developer is sucked by the suction pump and is conveyed to the developing unit.

The above-described image forming apparatus may further include a hopper disposed between the developing unit and the suction pump and configured to reservoir the two-component developer.

A portion of the developer conveying path may include a tube member formed with a flexible soft material.

Further, in one exemplary embodiment, a method of packing a two-component developer including toner and carrier includes frictionally charging the two-component developer by mixing and agitating the toner and the carrier having a weight ratio thereof to the two-component developer in a range from approximately 3 wt % to approximately 20 wt %, introducing compressed air to fluidize the two-component developer, and conveying the two-component developer into a developer container so that a developer containing portion of the developer container includes at least 12% of an air space after the two-component developer is left still for at least 24 hours.

Further, in one exemplary embodiment, a method of determining a condition of a two-component developer packed in a developer container includes obtaining a first height of the two-component developer in the developer container having at least 12% of an air space after the two-component developer is left still for at least 24 hours, measuring a second height of the two-component developer in the developer container left for a predetermined period of time, collecting data of a correlation of the first and second heights, and using the second height as a substitute for the first height so that the developer containing portion having at least 12% of the air space is obtained after the two-component developer is left still for the predetermined period of time.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
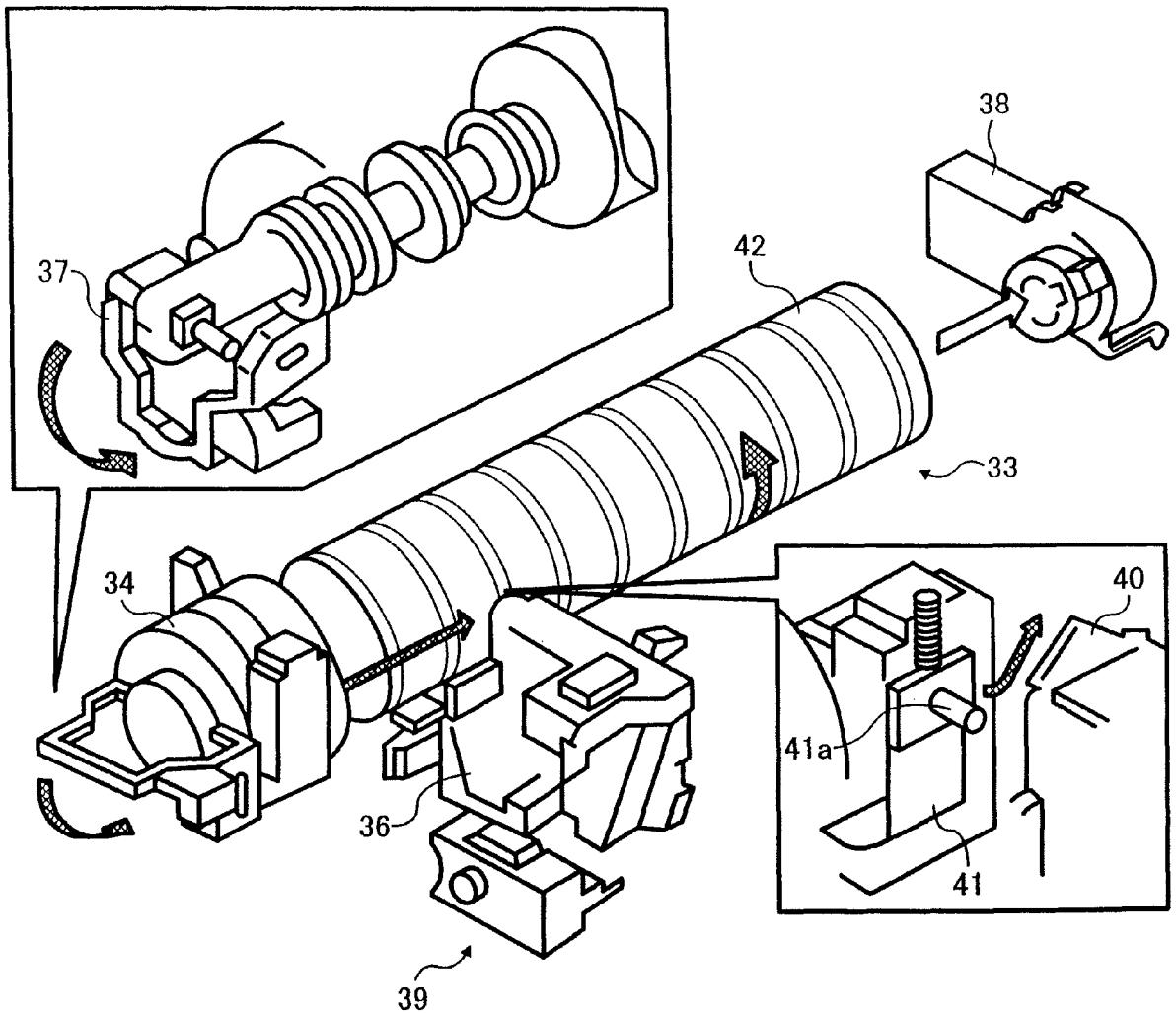
FIG. 1 BACKGROUND ART
FIG. 1 is a schematic structure of a background art of a bottle cartridge.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
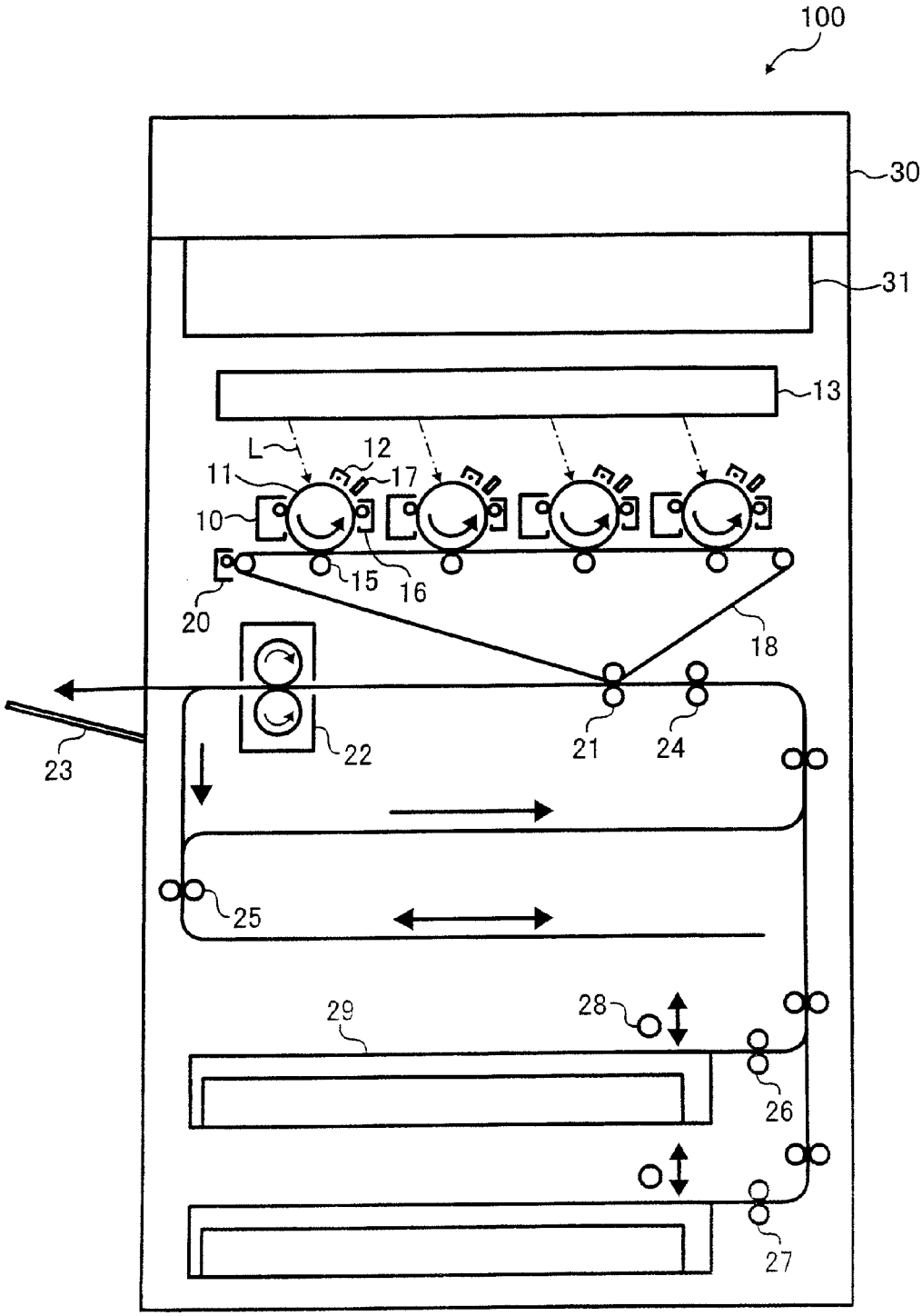
FIG. 2 is an image forming apparatus according to one exemplary embodiment of the present invention.

Referring to FIG. 2, a schematic structure of an image forming apparatus 100 according to the exemplary embodiment of the present invention is described.

The image forming apparatus 100 is a full color image forming apparatus employing a tandem system with four drums and an intermediate transfer unit and a developing method using a two-component developer. However, an image forming apparatus and the method applied to the present invention is not limited to the image forming apparatus 100, but other image forming apparatuses that employs a method using a dry-type two-component developer can also be applied to the present invention.

The image forming apparatus 100 of FIG. 2 includes a photoconductive element 11, a charger 12, an optical writing unit 13, a developing unit 10, a primary transfer roller 15, a photoconductive element cleaning unit 16, a discharge lamp 17, an intermediate transfer belt 18, an intermediate transfer belt cleaning unit 20, a secondary transfer roller 21, a fixing unit 22, a sheet discharging tray 23, a pair of registration rollers 24, a switch back roller 25, sheet feeding rollers 26 and 27, a pickup roller 28, a sheet feeding tray 29, a automatic document feeder or ADF 30, a scanner 31, a volume reduction type developer supplying mechanism 200 (FIG. 3), and a laser light beam L.

The photoconductive element 11, the charger 12, the developing unit 10, the primary transfer roller 15, the photoconductive element cleaning unit 16, the discharge lamp 17, and the laser light beam L are equally provided to each of four image forming units. The image forming unit having the above-described respective components can be applied to any of the image forming units in the image forming apparatus 100 of FIG. 2. Since the image forming units and components used for the image forming operations performed by the image forming apparatus 100 have similar structures and functions, except that respective toner images formed thereon are of different colors, which are yellow, magenta, cyan, and black toners, the discussion in FIG. 8 uses reference numerals for specifying components of the image forming apparatus 100 without the suffixes.

The photoconductive element 11 serves as an image bearing member and bears an image on a surface thereof. The photoconductive element 11 is held in contact with the intermediate transfer belt 18.

The charger 12 uniformly charges the surface of the photoconductive element 11.

The optical writing unit 13 serves as an exposing unit and is disposed above the photoconductive element 11. The optical writing unit 13 emits the laser light beam L and irradiates the surface of the photoconductive element 11 so that an electrostatic latent image can be formed on the surface of the photoconductive element 11.

The developing unit 10 receives developer from the volume reduction type developer supplying mechanism 200. The developing unit 10 develops the electrostatic latent image formed on the photoconductive element 11 into a visible toner image.

The primary transfer roller 15 is disposed opposite to the photoconductive element 11 and is held in contact with the intermediate transfer belt 18. That is, the primary transfer roller 15 and the photoconductive element 11 contact with each other, sandwiching the intermediate transfer belt 18. The primary transfer roller 15 and the photoconductive element 11 form a primary nip therebetween. The primary transfer roller 15 applies a transfer bias and a pressure force to transfer the toner image formed on the photoconductive element 11 onto the intermediate transfer belt 18.

The photoconductive element cleaning unit 16 removes residual toner remaining on the surface of the photoconductive element 11.

The discharge lamp 17 removes the charge remaining on the surface of the photoconductive element 11.

The intermediate transfer belt 18 is disposed below the photoconductive element 11 held in contact with a surface thereof. The intermediate transfer belt 18 forms an endless belt, extended by and spanned around a plurality of supporting rollers. The intermediate transfer belt 18 receives the respective toner images formed on the corresponding photoconductive elements 11. The respective toner images are sequentially transferred onto the surface of the intermediate transfer belt 18 to form a full-color toner image.

The intermediate transfer belt cleaning unit 20 removes residual toner remaining on the surface of the intermediate transfer belt 18.

The secondary transfer roller 21 is disposed opposite to one of the plurality of supporting rollers of the intermediate transfer belt 18. The secondary transfer roller 21 and the supporting roller form a secondary nip therebetween to transfer the full-color toner image onto the recording medium conveyed from one of the sheet feeding trays 29.

The fixing unit 22 fixes the full-color toner image to the recording medium by applying heat and pressure.

The sheet discharging tray 23 receives a sheet stack discharged after the fixing unit 22.

The pair or registration rollers 24 feeds and stops the recording medium in synchronization with a movement of the intermediate transfer belt 18.

The switch back roller 25 is used to change the sheet conveying direction so that the recording medium can be discharged from a sheet reversing portion.

The sheet feeding rollers 26 and 27 respectively feed the recording medium from the corresponding sheet feeding trays 29.

The sheet feeding trays 29 accommodate respective recording media therein.

The ADF 30 automatically feeds a document sheet or sequentially feeds document sheets placed thereon.

The scanner 31 reads image data recorded or formed on a document sheet.

Figure 3:
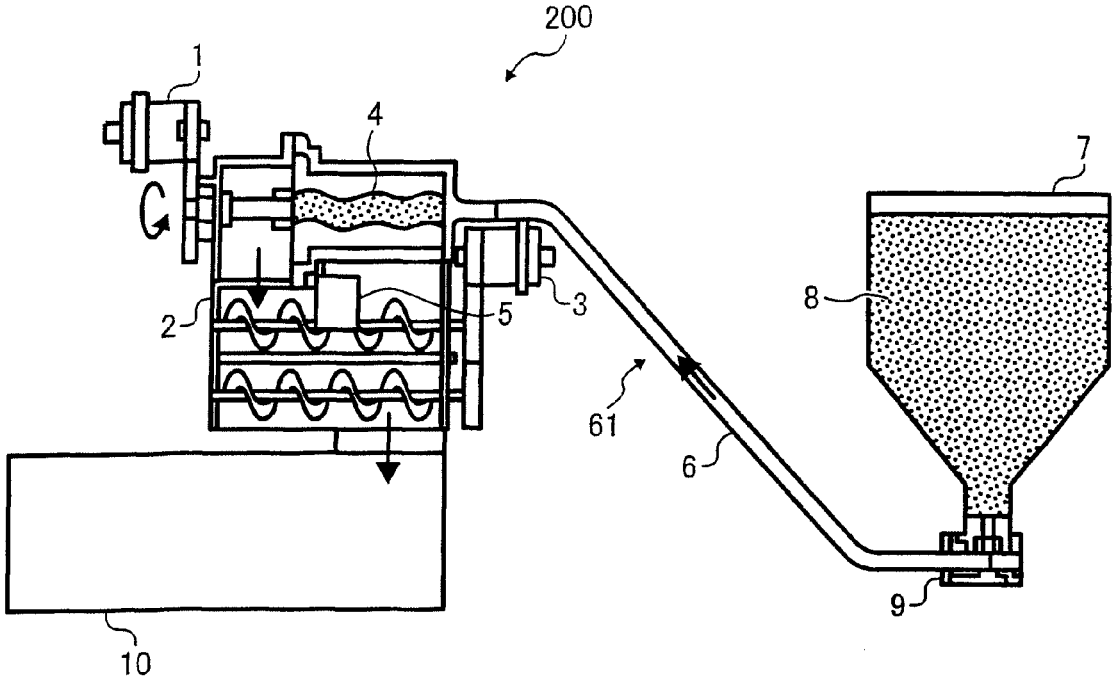
FIG. 3 is a schematic structure of a developer supplying mechanism employed in the image forming apparatus according to one exemplary embodiment of the present invention.

Further, the image forming apparatus 100 includes a volume reduction type developer supplying mechanism 200, which is not shown in FIG. 2 but is shown in FIG. 3. The volume reduction type developer supplying mechanism 200 is disposed in the vicinity of the optical writing unit 13, the photoconductive element 11 and other image forming components disposed around the photoconductive element 11 in the image forming apparatus 100 of FIG. 2.

The volume reduction type developer supplying mechanism 200 replenishes toner or developer to the developing unit 10. A detailed description of the volume reduction type developer supplying mechanism 200 will be made later.

Now, image forming operations of the image forming apparatus 100 are described.

When a print start command is issued, rollers disposed around the photoconductive element 11, the intermediate transfer belt 18, and a sheet conveying path (not shown) start rotating and a recording medium is fed from the sheet feeding tray 29.

The charger 12 uniformly charges the surface of the photoconductive element 11, and the optical writing unit 13 emits the laser light beam L to irradiate the surface of the photoconductive element 11 according to image data to form an electrostatic latent image.

The developing unit 10 accommodates a dry-type two-component developer replenished by the volume reduction type developer supplying mechanism 200. The developing unit 10 supplies toner to develop the electrostatic latent image into a visible toner image. The image forming apparatus 100 shown in FIG. 2 includes four photoconductive elements so as to form four single color toner images, which are yellow, magenta, cyan, and black toner images.

When each of the respective single color toner images reaches a contact portion with the intermediate transfer belt 18, the primary transfer roller 15 disposed opposite to the photoconductive element 11 applies the transfer bias and the pressure force so that the toner image can be transferred onto the surface of the intermediate transfer belt 18. The respective single color toner images are sequentially transferred and overlaid by performing the above-described transfer operation, and thus a full color toner image is formed on the intermediate transfer belt 18.

The full color toner image formed on the intermediate transfer belt 18 is further transferred onto a recording medium with its conveying timing controlled by the pair of registration rollers 24. Specifically, the full color toner image is transferred at the secondary nip on which the secondary transfer roller 21 applies a secondary transfer bias and a pressure force.

The recording medium having the full color toner image thereon is conveyed to the fixing unit 22. The fixing unit 22 fixes the full color toner image to the recording medium by applying heat and pressure.

The recording medium having the fixed full color toner image is then being discharged to the sheet discharging tray 23 when the printing operation is for producing a one side copy.

When performing a duplex copy operation, the recording medium is conveyed in a vertically downward direction to a sheet reversing portion. When the recording medium reaches the sheet reversing portion, the switch back roller 25 changes the sheet conveying direction to a reverse direction so that the recording medium may be discharged from the trailing edge thereof. By changing the sheet conveying direction, a print target surface of the recording medium can be changed. The reversed recording medium goes back to the sheet conveying path, upstream of the pair of registration rollers 24. Then, the recording medium repeats the same step for printing, and passes through the fixing unit 22 before discharged to the sheet discharging tray 23.

After the photoconductive element 11 has transferred the single color toner image onto the intermediate transfer belt 18, the photoconductive element cleaning unit 16 removes residual toner from the surface of the photoconductive element 11. Then, the discharge lamp 17 uniformly discharges or removes residual electric charge from the surface of the photoconductive element 11. Thus, the photoconductive element 11 may be prepared for the next printing operation.

Further, after the intermediate transfer belt 18 has transferred a full color toner image onto a recording medium, the intermediate transfer belt cleaning unit 20 removes residual toner from the intermediate transfer belt 18.

Referring to FIG. 3, a schematic structure of the volume reduction type developer supplying mechanism 200 according to one exemplary embodiment of the present invention, included in the image forming apparatus 100, is described.

As previously described, the volume reduction type developer supplying mechanism 200 of FIG. 3 is included in the image forming apparatus 100.

The volume reduction type developer supplying mechanism 200 of FIG. 3 includes a pump clutch 1, a hopper 2, a hopper clutch 3, a powder suction pump 4, a toner empty sensor or TE sensor 5, a tube member 6, a developer cartridge 7, a developer 8, a nozzle 9, a developing unit 10, and a developer conveying path 61.

The pump clutch 1 is used to drive the powder suction pump 4. Specifically, the pump clutch 1 is engaged when the powder suction pump 4 starts its operation and is disengaged when the powder suction pump 4 stops.

The hopper 2 accommodates or reservoirs the developer 8 to convey the developer 8 to the developing unit 10 connected thereto.

The hopper clutch 3 is used to drive the hopper 2.

The powder suction pump 4 sucks the developer 8 from the developer cartridge 7 via the tube member 6 and conveys the developer 8 to the hopper 2.

The TE sensor 5 monitors the amount of the developer 8 in the hopper 2 and senses a toner empty state.

The tube member 6 includes a flexible soft material that can flexibly change its form. The tube member 6 is connected to the nozzle 9 at one end and to the pump 4 at the other end.

The powder suction pump 4 and the tube member 6 form the developer conveying path 61 between the developer cartridge 7 and the developing unit 10.

The developer cartridge 7 serves as a developer container and accommodates the developer 8 therein.

The nozzle 9 is used to connect the developer cartridge 7 and the tube member 6 so as to convey the developer 8.

The developing unit 10 receives the developer 8 from the hopper 2 to develop an electrostatic latent image formed on an image bearing member into a visible toner image.

Figure 4:
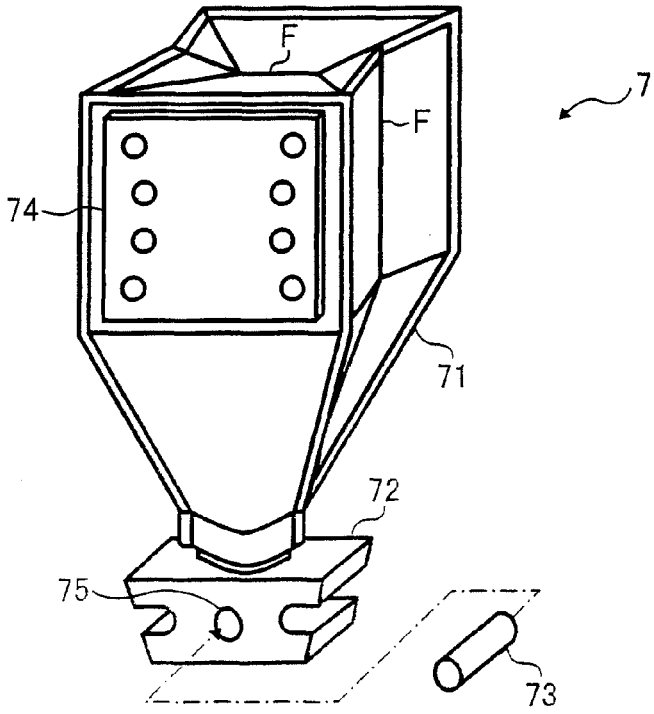
FIG. 4 is a schematic diagram of a developer container of the toner supplying mechanism of FIG. 3.

Referring to FIG. 4, a detailed structure of the developer cartridge 7 of FIG. 3 is described.

The developer cartridge 7 of FIG. 3 includes a bag-like developer case 71, a cap 72, a piston 73, a reinforcing member 74, a developer outlet 75, and folds F.

The bag-like developer case 71 works as a developer containing portion to accommodate the developer 8 packed in the developer cartridge 7.

The cap 72 is used to connect the developer cartridge 7 and the nozzle 9 to communicate to the powder suction pump 4 so that the developer 8 can be sucked by the powder suction pump 4 and be smoothly conveyed to the developing unit 10 via the nozzle 9, the tube member 6, the powder suction pump 4, and the hopper 2 of the developer supplying mechanism 200 of FIG. 3.

The piston 73 serves as a shutter member and contacts the nozzle 9 when the nozzle 9 is inserted to the cap 72. When the piston is pushed 73, the nozzle 9 becomes communicated to the bag-like developer case 71.

The reinforcing member 74 is arranged such that an operator can easily grip and hold the developer container 7 with his or her fingers put in plural perforations as shown in FIG. 3. The reinforcing member 74 is also arranged such that the bag-like developer case 71 is folded along the folds F to a compact shape more easily without causing a stop of developer flow.

The folds F are previously formed in the manufacturing process of the bag-like developer case 71 to promote the bag-like developer case 71 to smoothly be folded.

The developer outlet 75 is an opening to discharge the developer 8 from the bag-like developer case 71.

Thus, the developer 8 is supplied to the developing unit 10. The developer 8 includes carrier and toner with the amount of toner rather higher than the amount of carrier. Specifically, a weight ratio of the carrier to the developer 8 is controlled to be in a range from approximately 3 wt % to approximately 20 wt %. By controlling to obtain the above-described weight ratio or mixture rate of the carrier to the developer 8, the developer 8 can be effectively mixed at a predetermined mixture rate with a preexisting developer previously accommodated in the developing unit 10. This can maintain a preferable toner density for the image forming operations to be performed after one image forming operation.

The developer cartridge 7 of the present invention employs the bag-like developer case 71 that serves as a developer containing portion including a flexible material. The bag-like developer container 71 of the developer cartridge 7 can be folded automatically while the developer 8 contained in the internal space thereof is being sucked, then be folded manually after the developer 8 contained therein is used up.

The reinforcing plate 74 may be attached on the surface(s) of the bag-like developer case 71 of the developer cartridge 7 as shown in FIG. 3. The reinforcing plate 74 may help prevent deformation of at least one surface, which may be front and/or rear surfaces, of the bag-like developer case 71 of the developer cartridge 7 and guide to fold the bag-like developer case 71 along with the folds F formed on the other surfaces, which may be side surfaces. Thereby, the bag-like developer case 71 of the developer container 7 can be folded into a predetermined form when the volume of the bag-like developer case 71 is reduced due to the suction of the developer 8.

As shown in FIG. 3, the developer cartridge 7 is packed with the developer 8. The developer cartridge 7 includes the developer outlet 75 mounted on the cap 72 disposed at the bottom of the developer cartridge 7 to be connected to the nozzle 9. The developer 8 in the developer cartridge 7 falls by its own weight to gather toward the developer outlet 75.

As described above, the bag-like developer case 71 may include a plurality of surfaces and be formed with a soft and flexible material. However, it is not necessary for the entire surfaces of the bag-like developer case 71 to be flexible. It is preferable that the upper and other surfaces including the folds F include the flexible material and that the at least one surface, or the front and rear surfaces, having the reinforcing plate 74 thereon include a resin material or a similar rigid material such as a thin metal.

A toner density sensor (not shown) disposed in the developing unit 10 determines whether a toner density in the developing unit 10 becomes lower than a predetermined level. When the toner density sensor in the developing unit 10 outputs the result that the toner density is low, the pump clutch 1 is engaged to rotate the suction type powder pump 4 (hereinafter referred to as the "pump 4"). After the pump 4 has been driven, the developer 8 may be sucked through the tube member (hereinafter referred to as the "flexible tube 6") that connects the nozzle 9 and the pump 4 and conveyed into the pump 4. In FIG. 3, the volume reduction type developer supplying mechanism 200 includes the hopper 2 to accommodate or reservoir the developer 8. The hopper 2 drives conveying screws mounted therein so that the developer 8 can be conveyed from the hopper 2 to the developing unit 10.

The pump 4 may be driven to control to supply the developer 8 to the developing unit 10 by the amount the developing unit 10 needs to be replenished. Alternatively, the volume reduction type developer supplying mechanism 200 can have a different structure in which the developer 8 is directly replenished from the pump 4 to the developing unit 10 without the hopper 2. Specifically, a relationship of the predetermined drive period of the pump 4 and the amount of the developer 8 to be replenished can be previously calculated or obtained and the pump 4 may control to supply the developer 8 by a predetermined amount thereof. The toner density sensor of the developing unit 10 determines, at predetermined intervals, whether the toner density is within an appropriate range or not. When the toner density sensor determines the toner density is appropriate, the pump clutch 1 is disengaged to stop the pump 4 so that the replenishment of the developer 8 can be stopped.

When the developer 8 is replenished, the amount of developer, or carrier in this case, in the developing unit 10 may exceed a predetermined amount, and thereby the toner density in the developing unit 10 may not be maintained to an appropriate range.

There is one developer replenishing method or process to supply toner and carriers to a developing unit while a different developer replenishing method or process supplies toner. The developer replenishing method or process that replenishes both toner and carrier is known as the trickle development. In the trickle development process, the surplus amount of developer or carrier can be discharged so that the predetermined amount of developer can be maintained in the developing unit. Specifically, the carrier deteriorated due to repeated image forming operations may be discharged from the developing unit. Thus, with the trickle development process, toner can be replenished while carriers may automatically be replaced.

There are some types of the trickle development process. For example, one type of the trickle development process supplies toner and carriers at the same time while another type of the trickle development process supplies toner and carriers separately and mixes them in the developing unit. The latter type, however, requires respective containers and replenishing mechanisms for both toner and carrier. Therefore, an image forming apparatus employing the latter type process require an internal space and external size greater than an image forming apparatus employing the former type process.

The developing unit 10 according to one exemplary embodiment of the present invention may employ the former type of the trickle development process.

To effectively utilizing the trickle development process, the weight ratio of the carrier to the preexisting developer previously accommodated in the developing unit 10 may be maintained in a range from approximately 87 wt % to approximately 97 wt %, preferably in a range from approximately 90 wt % to approximately 95 wt %. This can maintain an image density in good quality and reduce or prevent fogging on an image.

As previously described, the developer supplying mechanism 200 according to an exemplary embodiment of the present invention may employ the pump 4, which is a suction type powder pump that sucks and conveys the developer 8 from the developer cartridge 7. Accordingly, a rotary bottle that has a spiral groove thereon and that contains developer is not necessary for the developer supplying mechanism 200. Therefore, the selective subduction or sink of the carrier to the spiral groove or a lower portion of the internal space of the bag-like developer case 71 of the developer container 7 may not occur.

As an alternative to the flexible material of the developer cartridge 7, the image forming apparatus 100 may employ a rigid material for accommodating the developer 8. When the developer 8 accommodated in a rigid container formed by, for example, a resin material may fall by its own weight, an appropriate discharging amount of the developer 8 needs to be controlled. To prevent excessively discharging the developer 8, the developer outlet of the rigid container needs to be made small. However, when the developer 8 is blocked at the developer outlet, there is no other discharge way except for gravity. This may cause the discharging amount of the developer to become insufficient. Therefore, it is preferable to use the volume reduction type developer supplying mechanism 200 that uses the powder pump 4 and the developer cartridge 7 including the bag-like developer case 71 to prevent the block of the developer 8 when the developer is discharged from the developer cartridge 7.

The above-described effect can be exerted even when the developer cartridge 7 includes a rigid material or a flexible material. The developer cartridge 7 according to the exemplary embodiment of the present invention includes a flexible material on a partial or entire surface of the bag-like developer case 71. With the above-described structure of the developer cartridge 7, the bag-like developer case 71 may reduce its volume according to the suction force of the pump 4. Thereby, the developer 8 may not be unnecessarily agitated and can maintain the same mixture condition as the condition dispersed before being replenished to the developer cartridge 7 and be discharged to the outside of the developer cartridge 7.

Figure 5:
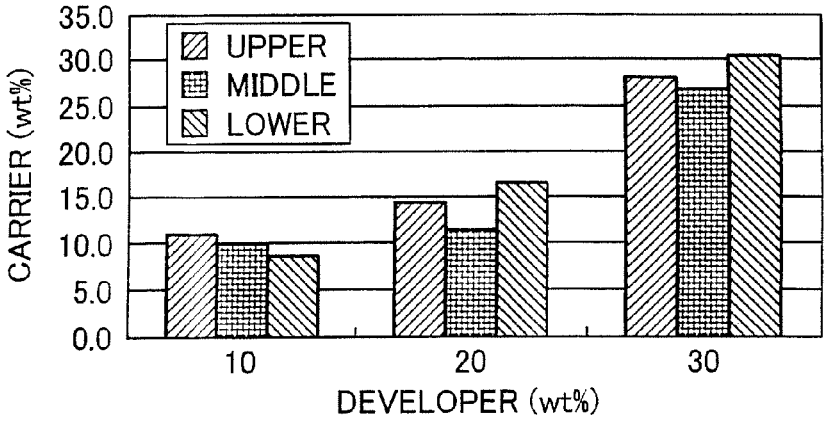
FIG. 5 is a graph showing weight ratios of a carrier to a developer.

Referring to FIG. 5, a graph showing a measurement result of a carrier distribution in the developer cartridge 7 when the developer 8 is unused for a predetermined period of time is described.

In FIG. 5, respective weight ratios of the carrier were measured in the vicinity of the upper, middle, and bottom portions of the developer cartridge 7.

The weight ratio of the carrier in the developing unit 10 according to the exemplary embodiment of the present invention is set within a range from approximately 90 wt % to approximately 95 wt %. However, the carrier may be replenished to the developing unit 10 and, at the same time, may be sequentially replaced with deteriorated or abraded carriers previously accommodated in the developer cartridge 7. As the abundance ratio of the carrier in the developing unit 10 is higher, the amount of newly replenished carrier to be wasted may become higher. Since such a waste of the newly replenished carrier is not economical, it is preferable that the abundance ratio of the carrier be in a rather small range, for example, from approximately 5 wt % to approximately 10 wt %.

The measurement result of the distributions of the carrier in the developer cartridge 7 shown in FIG. 5 was obtained through a measurement described below.

The developer cartridges 7 packed with the developer 8 were prepared to have the respective weight ratios of the carrier to the entire developer 8 to be approximately 10 wt %, 20 wt %, and 30 wt %, and were left for two days. Then, samples of the respective carriers of the developer cartridges 7 were taken from three portions, which were located in the vicinity of the upper, middle, and lower portions. According to the samples, respective local weight ratios of the carrier in each of the developer cartridge 7 were measured.

According to the results shown in FIG. 5, the weight ratios (wt %) of the carrier were almost identical in the vicinity of the upper, middle, and lower portions even though there were slight differences depending on locations in the vertical direction of the developer cartridge 7. Consequently, the subduction or sink of the carrier that can cause an uneven distribution of the carrier in the developer cartridge 7 to induce defects in toner density did not occur.

The weight ratio of the carrier or the weight ratio of toner, which is a toner density, may be obtained as described below.

In the exemplary embodiment of the present invention, the weight ratios of the carrier and the toner were measured using a "blow-off" type measurement system, MODEL 210HS-2A manufactured by TREK JAPAN Co., Ltd. The measurement system can measure toner density and the average charge amount per mass "q/m" at the same time.

The charge amount of each of the toners can be measured as follows.

A case having an opening covered by a filter capable of trapping the carrier and passing the toner therethrough is prepared. A sample developer is put in the case to previously measure the weight of the developer by an electrobalance.

A suction type powder pump separates the toner and the carrier by suctioning. The toner is absorbed in a Faraday gauge equipped with the filter, and an electrometer is connected to the Faraday gauge to measure the toner charge amount "q" of the absorbed toner in the Faraday gauge via the filter.

Here, the increased mass from the preliminarily measured mass of the filter may be determined as the mass of the toner placed on the filter, and the toner may be weighed. The toner density may be calculated on percentage with respect to the weight of the developer before the measurement. The total charge amount "q" of toner can be divided by the mass "m" of the toner T to determine the charge amount per mass (q/m).

Figure 6:
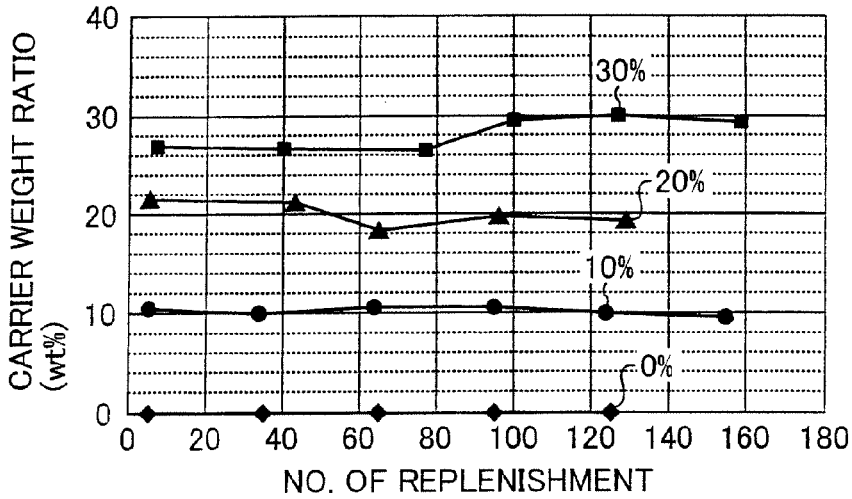
FIG. 6 is a graph showing weight ratios of the carrier with respect to the number of replenishments of the developer.

Referring to FIG. 6, a graph shows changes of the weight ratios of the carrier along with an increase of the number of replenishments of the toner.

In FIG. 6, four different weight ratios of the carrier, which are the weight ratios of 0 wt %, 10 wt %, 20 wt %, and 30 wt %, are shown.

When the larger amount of the toner is discharged to replenish to the developing unit 10, the weight ratio of the carrier in the developer cartridge 7 may become greater. When the larger amount of the carrier is discharged, the weight ratio of the carrier in the developer cartridge 7 may become smaller. Consequently, it can be seen that the entire weight ratio of the carrier has not remarkably been changed.

As previously described, the developer cartridge 7 employs a flexible material. When the pump 4 sucks the developer 8 from the developer cartridge 7, the shape of the bag-like developer case 71 may gradually change or become smaller in synchronization with a reduction of the volume of the internal space thereof. Therefore, the developer 8 in the developer cartridge 7 may be discharged without being agitated and the weight ratio (wt %) of the carrier may not be changed from the initial state of the developer 8 packed in the developer cartridge 7.

Figure 7:
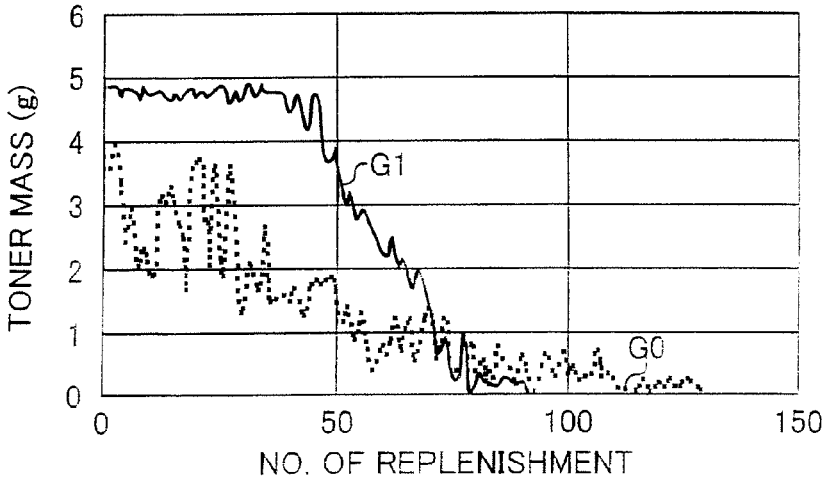
FIG. 7 is a graph showing toner mass with respect to number of replenishments.

Referring to FIG. 7, the graph shows the difference of air space or porosities of the toner mass in an internal space of the bag-like developer case 71 of the developer cartridge 7.

In FIG. 7, a dotted curve line "G0" represents the toner mass having 0% of the air space of the internal space of the bag-like developer case 71, and a solid curve line "G1" represents the toner mass having the sufficient air space of the internal space of the bag-like developer case 71. That is, "G0" indicates no air space and "G1"indicates sufficient air space for discharging the developer 8.

In the developer supplying mechanism 200 of the volume reduction type, the developer 8 is discharged as air in the air space of the upper portion of the developer case 71 is gradually discharged.

During the examinations for the present invention, it was found that, when a volume reduction type developer cartridge packed with the developer having no air space was used, a "packing phenomenon" could occur. The packing phenomenon is a phenomenon like a vacuum packing, in which a developer cannot be discharged by an ambient pressure. Specifically, the developer may become unmovable in the developer cartridge due to the packing phenomenon.

There may be an air space above a top surface or interface 110*a* (see FIG. 11) of the developer 8. In the exemplary embodiment of the present invention, a volume ratio of the air space with respect to the entire volume or the inside space of the developer cartridge 7 is referred to as the "porosity." The developer cartridge 7 having 12% or more of the porosity can stably discharge the developer 8 until the completion of discharge of the developer 8.

Figure 8:
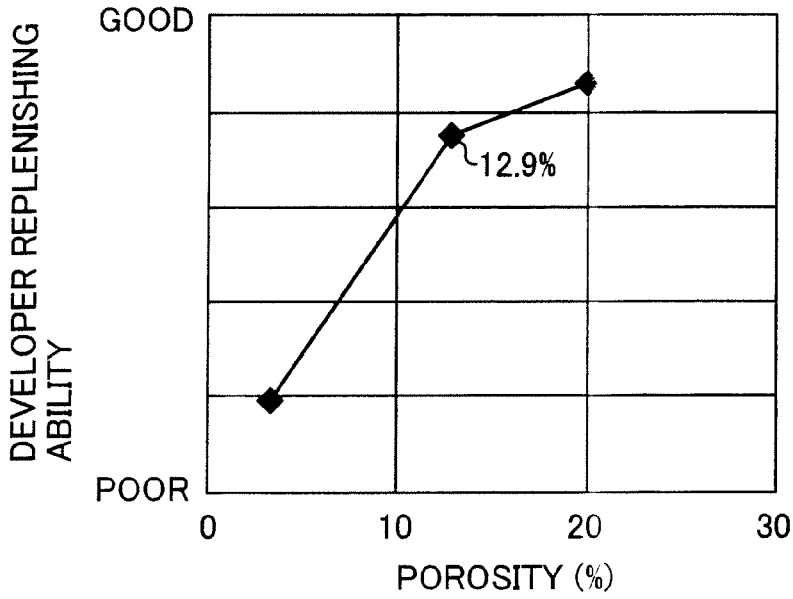
FIG. 8 is a graph showing developer replenishing ability with respect to the porosity of the developer container.

Referring to FIG. 8, developer replenishing or discharging ability with respect to the porosity of the developer cartridge 7 is shown.

As previously described, the developer 8 cannot be discharged or sucked from the developer cartridge 7 when the porosity of the developer cartridge 7 is 0%. While water or liquid can be discharged from a container even if there is no porosity in the container, a powder or the developer 8 cannot be discharged or sucked without air in the container. When air is mixed with the developer 8 in the developer cartridge 7, toner particles in the developer 8 can be separated so that the toner particles can move freely. This may elevate the level of developer replenishing or discharging ability. Therefore, a predetermined amount of porosity may be applied to the developer cartridge 7.

The inventors conducted a test to obtain an appropriate porosity to discharge the powder effectively. FIG. 8 shows the result of the test. As shown in the graph of FIG. 8, it was found through the test that the developer 8 can be smoothly discharged after the porosity reaches 12.9%. As a result, when the developer replenishing or discharging ability with respect to the porosity of the developer cartridge 7 is 12% or above, the developer 8 can smoothly be discharged.

Further, when the weight ratio of the carrier to a total volume of the developer 8 is set to approximately 3 wt % or above, the developer 8 packed in the developer cartridge 7 may include a stable amount of carrier having higher flowability than toner. As a result, each carrier particle that carries a predetermined amount of toner particles therearound in the developer cartridge 7 may be conveyed more easily to the vicinity of the developer outlet 75 of the developer cartridge 7. Further, the carrier in the developer 8 may also serve as a lubricant. The carrier serving as a lubricant may break the bond of adhesion between toners so that each toner can smoothly move. Such toner can also smoothly move even when the developer cartridge 7 has less air space. Therefore, even when the volume of the bag-like developer case 71 is reduced, the developer 8 may stably be conveyed. On the other hand, when the weight ratio of the carrier is approximately 30 wt % or greater, the developer 8 may be coagulated in the vicinity of the developer outlet 75 of the developer cartridge 7. This may decrease the flowability of the developer 8 and prevent a stable replenishment of the developer 8.

The developer 8 employing the above-described weight ratio of the carrier may effectively work when the developer 8 is discharged from the developer cartridge 7 regardless of the presence of additives. To enhance the flowability, it is preferable that the toner is previously mixed with a lubricant having the weight ratio of the additives to the toner in a range from approximately 0.3 wt % to approximately 3.0 wt %. An example of a lubricant may include, for example, silica, titanium, and so forth. Such a lubricant may serve as a spacer to coagulation between toners to thereby enhance the flowability of the developer 8.

The flowability can be expressed in an accelerated coagulation.

The measuring method of the accelerated coagulation in the exemplary embodiment of the present invention is described. The measuring instrument may include:

(1) Powder characteristics tester (manufactured by Hosokawa Micron Ltd.) including the parts such as classifier presser, space ring, fixed chute, vibro chute, and presser bar;

(2) Three types of classifiers (Condition 1); and (3) Digital counter scale.

Table 1 shows procedures of the measurement to take from No. 1 through No. 7 in order.

TABLE 1

| Procedure No. | Things to do | Tips |
|---|---|---|
| 1 | Turn on power supplies of a draft chamber and the main body of the tester. | |
| 2 | Measure the empty weight of each classifiers. | |
| 3 | Mount the following parts to the shaking table:<br>Vibro chute;<br>Classifiers (three types);<br>Space ring;<br>Packing; and<br>Presser bar. | Overlay the three classifiers. |
| 4 | Turn the vibration tapping switch to VIB, press a start button, and adjust an adjusting dial such that an amount of width for shaking the classifiers is a predetermined amount (Condition 2). | |

TABLE 1-continued

| Procedure No. | Things to do | Tips |
|---|---|---|
| 5 | Measure the predetermined amount of sample powder developer (Condition 3) and gently put the sample developer on the uppermost classifier. | |
| 6 | Turn on the start button and shake the classifiers for a predetermined period of time (Condition 4). | |
| 7 | Stop shaking the classifier, gently loose the knob nuts of the tester to detach the three classifiers, and weigh the classifiers and the sample powder developer trapped on the classifiers. | |

The accelerated coagulation can be obtained with Expressions 1 through 3 as shown below.

(Weight of sample developer trapped on the uppermost classifier/Amount of sample developer passed through the classifiers)*100 [Expression 1]

(Weight of sample developer trapped on the middle classifier/Amount of sample developer passed through the classifiers)*100*3/5 [Expression 2]

(Weight of sample developer trapped on the lowest classifier/Amount of sample developer passed through the classifiers)*100*1/5 [Expression 3]

The sum of Expressions 1, 2, and 3 may be represented as the accelerated coagulation of the sample powder developer.

Table 2 shows a list of measurement conditions for the present invention.

TABLE 2

| Condition (Predetermined Value) | Target | Unit | Value |
|---|---|---|---|
| 1 | Uppermost classifier | μm | 75 |
| 1 | Middle classifier | μm | 45 |
| 1 | Lowest classifier | μm | 20 |
| 2 | Amount of width for shaking classifiers | mm | 1 |
| 3 | Amount of sample powder developer | g | 2.00 ± 0.01 |
| 4 | Period of time for shaking classifiers | sec | 10 |

According to the above-described measurement method, when the value of the accelerated coagulation is equal to or smaller than 10%, a stable replenishing ability can be maintained regardless of a manufacturing method of additives, materials of toner, and charging characteristics.

Figure 9A:
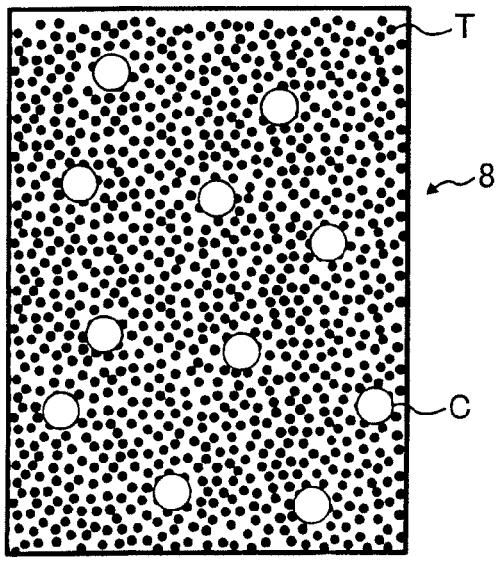
FIGS. 9A and 9B are schematic diagrams showing conditions of developer before and after receiving vibration, respectively, according to one example of an exemplary embodiment of the present invention.
Figure 9B:
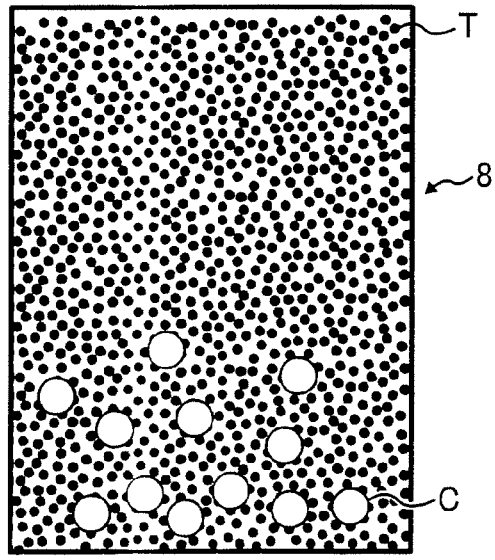

Referring to FIGS. 9A and 9B, schematic diagrams showing the states of the developer 8 in the developer cartridge 7 according to the exemplary embodiment of the present invention are described.

FIG. 9A shows the state of the developer 8 with a carrier C evenly distributed. FIG. 9B shows the state of the developer 8 after the developer cartridge 7 is repeatedly vibrated or shaken.

As previously described, the developer 8 packed in the developer cartridge 7 is not agitated while the developer 8 is discharged for replenishment and the carrier C may evenly be distributed as shown in FIG. 9A. It is, however, possible that the developer cartridge 7 packed with the developer 8 is repeatedly vibrated or shaken during transportation before the developer 8 is used. In that case, the carrier C may be likely to gradually sink to the lower portion of the developer cartridge 7, as shown in FIG. 9B.

Figure 10:
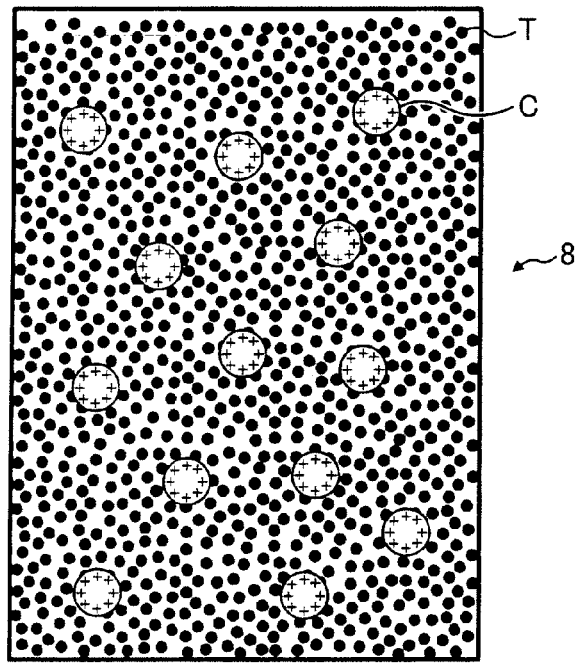
FIG. 10 is a different schematic diagram showing a condition of the developer according to a different example of an exemplary embodiment of the present invention.

Referring to FIG. 10, a schematic diagram showing the state of the developer 8 in the developer cartridge 7 according to another exemplary embodiment of the present invention is described.

The toner T and the carrier C of the developer 8 in FIG. 10 are sufficiently charged and mixed so that the carrier C is evenly distributed, before the developer 8 is packed in the developer cartridge 7. The carrier C is charged to a positive polarity and the toner T is charged to a negative polarity. After charged, the Coulomb force is generated to attract the carrier C and the toner T to each other so as to keep the carrier C evenly distributed in the developer 8 so that the carrier C is prevented from sinking.

Further, when the developer 8 is left for a long period of time, charge neutralization may be developed to gradually reduce the charges applied to the toner T and the carrier C. This may turn the developer 8 in the developer container 7 close to annihilation of the entire electric charges over the developer 8. When the developer 8 is not sufficiently dry, it is likely that the development of charge neutralization increases.

In the present invention, when the developer 8 is filled in the developer cartridge 7, it is controlled not to include moisture in the developer 8. Further, for preventing an increase of humidity while storing the developer 8, the developer cartridge 7 may include a material especially having a low rate of moisture vapor transmission. Details of the material of the developer cartridge 7 will be described later.

The developer 8 may be electrically charged such that a toner charge amount of the toner T can be equal to or greater than a toner charge amount when the carrier C is supplied to the developing unit 10 and is mixed with the preexisting developer previously accommodated in the developing unit 10 to agitate and charge the developer 8 by screws provided in the developing unit 10.

Since the weight ratio of the developer 8 and that of the preexisting developer previously accommodated in the developing unit 10 are remarkably different, the weight ratios thereof cannot easily be compared. Therefore, a nearly equal amount of toner charge may be determined to be an average amount of toner charge of the preexisting developer previously accommodated in the developing unit 10 obtained when the weight ratio of the carrier C is increased up to that of the preexisting developer while the developer 8 maintains the average amount of toner charge. In the exemplary embodiment of the present invention, the nearly equal amount of toner charge of the preexisting developer may become in a range from approximately −20 μC/g to approximately −30 μC/g.

Thus, the developer 8 can be agitated and electrically charged. After the charging operation to the developer 8, the developer 8 is packed into the developer cartridge 7. As previously described, the carrier C and the toner T in the vicinity of the carrier C are attracted to each other by the Coulomb force so that the carrier C can be prevented from sinking. When the developer 8 is supplied to the developing unit 10, at least the toner T has already been charged to the toner charge amount equal to or greater than the toner charge amount that can be obtained by agitation in the developing unit 10. Therefore, background contamination and toner scattering caused due to an insufficient toner charge can be reduced or prevented.

Further, even through the developer 8 is sufficiently charged before the developer 8 is packed in the developer cartridge 7, the carrier C and the toner T can be neutralized or electrically discharged during the packing operation. This may cause the sinking of the carrier C in the developer cartridge 7. To prevent the above-described sinking of the carrier C, the developer 8 may be frictionally charged when being packed into the developer cartridge 7. At the same time, background contamination and toner scattering caused due to an insufficient toner charge can be reduced or prevented when the carrier C is supplied to the developing unit 10.

Generally, an agitating member in a developing unit is used to cause a frictional charge between toners or between toner and carrier to obtain an amount of toner charge. However, the toner charge with the agitating member cannot cause the amount of toner charge to reach the maximum value of the developer 8. The maximum value of the developer 8 is hereinafter referred to as a "saturated amount of toner charge." In most cases, the amount of toner charge in use may be in a range from approximately 50% to approximately 80% of the saturated amount of toner charge. For example, when a saturated amount of toner charge is −40 μC/g, the average amount of toner charge in use, which is the toner charge amount in the developing unit, may be in a range from approximately −20 μC/g to approximately −30 μC/g.

The toner charge amount of the toner in the developer cartridge 7 is preferably as close as possible to the saturated amount of toner charge. The toner charge amount of the toner in the developer cartridge 7 may be preferably 50% or greater than the saturated amount of toner charge, and more preferably approximately 80% of the saturated amount of toner charge.

The average charge amount of toner in the developer cartridge 7 may be at least −20 μC/g, and more preferably −30 μC/g or greater.

As previously described, the developer cartridge 7 may preferably include a material having a low moisture vapor transmission rate. Specifically, the material may preferably include the moisture vapor transmission rate of 1.0 g/m$^2$ or smaller per 24 hours.

The JIS K 7126 A method (differential pressure method) may be used to measure the moisture vapor transmission rates of the entire materials including materials described below, according to the exemplary embodiment of the present invention. The above-described materials can reduce or prevent the charge neutralization of the developer 8 caused due to moisture absorption during transportation and storage after the developer 8 has been packed in the developer cartridge 7. By using the above-described materials for the bag-like developer case 71, the condition of the developer cartridge 7 with the carrier C and the toner T being sufficiently charged when packed therein can be maintained. Therefore, the sinking of the carrier C in the lower portion of the internal space of the developer cartridge 7 can be prevented, and the background contamination and toner scattering caused by an insufficient charge amount of the toner T can also be prevented when the developer 8 is supplied to the developing unit 10.

In the exemplary embodiment of the present invention, the developer cartridge 7 may employ a film having a triple layer structure using polyethylene, nylon, and PET for the entire portion of the bag-like developer case 71.

Similar to the developer cartridge 7, the flexible tube 6 serving as the developer conveying path 61 may avoid moisture absorption. It is preferable the flexible tube 6 include a material having a low moisture vapor transmission rate. Otherwise, during the actual operation, the toner T may absorb moisture before the toner T reaches the developing unit 10, and the charge applied to the developer 8 may be neutralized. When the developer 8 is neutralized, the carrier C may sink in the flexible tube 6 due to gravitational influence.

By employing a material having the moisture vapor transmission rate of 1.0 g/m$^2$ or smaller per 24 hours for the flexible tube 6 or the developer conveying path 61, the possibility of moisture absorption with respect to the developer 8 may be reduced or prevented when the developer 8 is supplied from the developer cartridge 7 to the developing unit 10.

Therefore, the charge condition of the carrier C and the toner T may be maintained in the same condition as the developer 8 is sufficiently charged when packed in the developer cartridge 7. This can reduce the possibility of or prevent the subduction of the carrier C in the developer conveying path 61 including the flexible tube 6. At the same time, the possibility of occurrence of background contamination and toner scattering due to a shortage of toner charge when the carrier C is supplied to the developing unit 10 may be reduced or eliminated.

In the exemplary embodiment of the present invention, the flexible tube 6 may include a silicon rubber. However, the material of the flexible tube 6 is not limited to the above-described material. Alternatively, fluorinated rubber, EPDM (ethylene propylene diene methylene linkage monomer), polyurethane rubber, and so forth, can be applied to the flexible tube 6 of the present invention.

Figure 11:
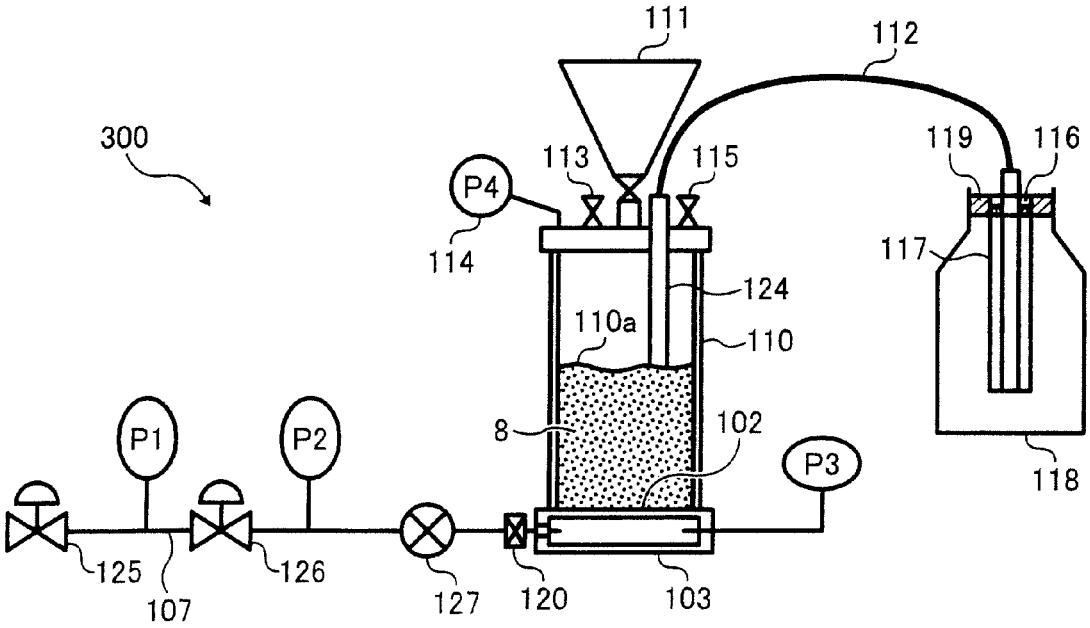
FIG. 11 is a developer packing mechanism for packing the developer to the developer container of FIG. 4.

Referring to FIG. 11, a schematic structure of a powder packing device 300 is described. The powder packing device 300 performs a powder packing process to fill the developer 8 in the developer cartridge 7.

The powder packing device 300 includes a filter or porous sheet 102, an air header 103, a vent pipe 107, a powder fluidizing unit 110, a powder entrance slot 111, a flow powder transport pipe 112, a pressure open valve 113, a pressure gauge 114 including a fourth pressure gauge P4, a powder flow rate control valve 115, a filter 116, a powder filling nozzle 117, a powder container 118, a soft packing 119, a powder control valve 120, a powder outlet tube 124, a first reducing valve 125, a second reducing valve 126, an air flow meter 127, a first pressure gauge P1, a second pressure gauge P2, and a third pressure gauge P3.

The powder fluidizing unit 110 is usually hermitically sealed.

The filter 102 is removably mounted on the bottom of the powder fluidizing unit 110.

The vent pipe 107 having the powder control valve 120 allows compressed air to flow therethrough. The vent pipe 107 is removably received in the air header 103 at one end thereof.

The powder entrance slot 111 with a valve (not shown) allows desired powder to be introduced therein.

The flow powder transport pipe 112 has one end connected to the filter 116 for the powder container 118 and the other end connected to the powder outlet tube 124.

The pressure open valve 113 is operated to release or confine pressure in the powder fluidizing unit 110.

The pressure gauge 114 including a fourth pressure gauge P4 is responsive to pressure inside of the fluidizing unit 10.

The powder flow rate control valve 115 is operated to finely control the flow rate of the powder.

The filter 116 is fitted on the end of the powder filling nozzle 117 adjoining the flow powder transport pipe 112.

The powder filling nozzle 117 is removably connected to the other end of the flow powder transport pipe 112.

The powder container 118 receives the powder conveyed via the flow powder transport pipe 112 and the powder filling nozzle 117.

The soft packing 119 surrounds the filter 116 and is implemented as a ring. The soft packing 119 fits onto a mouth of the powder container 118.

The powder outlet tube 124 extends out from the powder fluidizing unit 10.

The first and second reducing valves 125 and 126 and the air flow meter 127 are mounted on the vent pipe 107 in this order, which is a direction of air flow.

The first pressure gauge P1 intervenes between the first and second reducing valves 125 and 126.

The second pressure gauge P2 intervenes between the second reducing valve 126 and the air flow meter 127.

The third pressure gauge P3 is arranged at the air header 103.

Now, operations of charging the developer 8 before packing the developer 8 into the developer cartridge according to the exemplary embodiment of the present invention are described.

The charging operations in the exemplary embodiment of the present invention are measured using the TURBULA® shaker-mixer manufactured by Shinmaru Enterprises Corporation.

The toner may be measured by the desired amount, for example 500 g, and supplied from the powder entrance slot 111 to the powder fluidizing unit 110. The amount of carrier in a range from approximately 16 g to approximately 125 g may correspond to the weight ratio of the carrier in a range from approximately 3 wt % to approximately 20 wt %, with respect to the amount of the entire developer including the toner. The desired amount of carrier may be measured from the above-described range, and be supplied form the powder entrance slot 111 to the powder fluidizing unit 110 so that the carrier and the toner can be mixed as the powder.

The mixed powder may be strongly agitated and mixed by the TURBULA® shaker-mixer for approximately 60 seconds to charge the powder to reach a substantially same amount as the above-described toner charge amount. The charged powder may correspond to the developer 8 in the exemplary embodiment of the present invention. Air flow is used to pack the developer 8 into the developer cartridge 7.

Now, operations of packing the developer 8 into the developer cartridge 7 are described below.

Compressed air may be generated by a compressed air source (not shown) that is connected to the first reducing valve 125. Then, the compressed air may be introduced via the first reducing valve 125, then the second reducing valve 126, and so forth to the air header 103. The air header 103 is resistive to some pressure such that pressure inside the powder fluidizing unit 110 can be elevated. The compressed air is uniformly scattered into the developer 8 in the powder fluidizing unit 110 via the filter 102 and fluidizes the developer 8. The pressure conveys the developer 8 through the powder outlet tube 124 and through the flow powder transport pipe 112 to the powder filling nozzle 117. When the developer 8 forcedly discharged from the powder fluidizing unit 110 via the flow powder transport pipe 112 is inserted into the powder container 118, the compressed air exits from the powder container 118 through the filter 116. Thus, the developer 8 is packed and accumulated in the powder container 118.

When the powder container 118 corresponds to the developer cartridge 7, the developer cartridge 7 may be folded with the powder filling nozzle 117 inserted therein before packing the developer 8. The incoming compressed air injected as the developer 8 is packed exits from the developer cartridge 7 via the filter 116 while the developer cartridge 7 is gradually expanded or inflated. When the developer cartridge 7 becomes almost full of the developer 8 or becomes close to the maximum volume of the developer 8, the packing operation is stopped to release the compressed air so that the developer cartridge 7 can include a predetermined amount of air space and/or to add a small amount of the developer 8 so that the amount of air space can be arranged. After the above-described adjustments, the developer cartridge 7 is sealed, and then the packing of the developer 8 is completed.

Further, in addition to the filter 116, a straw-shaped air release pipe (not shown) capable of actively releasing air may be used to release a greater amount of air while packing the developer 8 into the developer cartridge 7 so that the developer cartridge 7 can be more easily adjusted to have approximately 12% or more of the porosity or air space ratio to the entire volume of the internal space thereof.

If the powder packing device 300 can provide a stable performance, the packing operation can effectively be performed and reserving the predetermined amount, which is approximately 12%, of air space without stopping and restarting for releasing air.

In the developer supplying mechanism 200 shown in FIG. 3, in which the developer 8 is supplied from the developer cartridge 7 via the flexible tube 6 to the developing unit 10, the pump 4 may be used to suck the developer 8 from the developer cartridge 7.

In a case in which the developer 8 is fully packed or occupies a 100% portion in the developer cartridge 7 without any air space, the packing phenomenon may occur as previously described, and thereby the developer 8 cannot effectively be discharged or supplied from the developer cartridge 7. Therefore, it is effective that the amount of the developer 8 be reduced to spare for an air space.

Specifically, after the developer 8 is packed in the developer cartridge 7, the space above the top surface or interface 110*a* of the developer 8 may be filled with air such that the entire portion of the inside space of the developer cartridge 7 becomes the maximum volume that corresponds to a volume filled with water. The porosity of the air space in the developer cartridge 7 can be obtained from the following expression:

$$\text{Porosity}=(\text{Maximum volume}-\text{Developer volume})/\text{Maximum volume}*100(\%).$$

After the developer 8 has been packed into the developer cartridge 7, the developer cartridge 7 may be left for at least 10 minutes to settle down the circulation of particles of the developer 8 in the developer cartridge 7. By leaving the developer cartridge 7 for at least 10 minutes, the bulk of the developer 8 in the developer cartridge 7 can accurately be measured by multiplying the area of the base surface of the developer cartridge 7 by the height of the developer 8 in the developer container 7.

Specifically, the developer 8 may include gas in small spaces between toners. The size of the small spaces may slightly change due to gravitational influence for a certain period of time after the developer 8 has been packed in the developer cartridge 7. From the above-described reason, the entire volume of the developer 8 may slightly be reduced. Therefore, the developer cartridge 7 may be left still for 24 hours or more to avoid the above-described change in the volume of the developer 8 packed in the developer cartridge 7 before the height of the developer 8 in the developer cartridge 7 is measured for calculating the porosity in the developer cartridge 7.

It is effective to previously collect a plurality of data about a correlation between the condition of the developer 8 when voluntarily leaving the developer cartridge 7 for 10 minutes or more and the condition of the developer 8 when leaving the developer cartridge 7 for 24 hours or more. That is, it is effective to obtain data of the height of the developer 8 that has been left still for 10 minutes or more so as to use the data as a substitute for the height of the developer 8 that has been left still for 24 hours or more. For producing the developer cartridge 7 in large quantities, it is preferable to use the value calculated based on the height of the developer 8 obtained after leaving the developer cartridge 7 for 10 minutes or for a voluntary period of time.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A developer container containing a two-component developer including a carrier and toner, the developer container comprising:

a developer containing portion configured to include a plurality of surfaces and to accommodate the two-component developer, the developer containing portion including a plurality of previously formed folds along which the developer container portion can be folded, and at least one reinforcing member on at least one exterior surface of the developer container portion; and a cap configured to communicate to a suction pump so that the two-component developer is sucked by the suction pump and is conveyed to a developing unit, wherein: the developer containing portion is configured to include an internal space of which at least 12% is an air space measured after the two-component developer is packed in the developer containing portion and left still for at least 24 hours, and wherein:

the two-component developer in the developer containing portion is electrically charged to have an amount of toner charge in a range from approximately −20 mC/g to approximately −30 mC/g.

2. The developer container according to claim 1, wherein: a weight ratio of the carrier to the two-component developer is in a range from approximately 3 wt % to approximately 20 wt %.

3. The developer container according to claim 1, wherein: the amount of toner charge to the two-component developer in the developer container is arranged to be equal to or greater than a different amount of toner charge obtained when the carrier is mixed with a preexisting developer previously accommodated in the developing unit.

4. The developer container according to claim 3, wherein: at least a portion of the amount of toner charge to the two-component developer in the developer container is arranged to be frictionally charged while the two-component developer is being packed into the developer containing portion.

5. The developer container according to claim 4, wherein: the two-component developer includes an accelerated coagulation equal to or less than 10%.

6. The developer container according to claim 1, wherein: the toner includes a lubricant having a weight ratio to the toner in a range from approximately 0.3 wt % to approximately 3.0 wt %.

7. The developer container according to claim 6, wherein: the two-component developer includes an accelerated coagulation equal to or less than 10%.

8. The developer container according to claim 1, wherein: the flexible material has a moisture vapor transmission rate of 1.0 g/m$^2$ or smaller per 24 hours.

9. An image forming apparatus, comprising:

a developing unit configured to develop a toner image with a two-component developer and to receive and discharge the two-component developer;

a suction pump configured to suck the two-component developer to convey to the developing unit;

a developer conveying path, a portion of which includes the suction pump, configured to convey the developer therethrough to the developing unit; and a developer container configured to contain the two-component developer including a carrier and toner, the developer container comprising:

a developer containing portion configured to include a plurality of surfaces and to accommodate the two-component developer, the developer containing portion including a plurality of previously formed folds along which the developer container portion can be folded, and at least one reinforcing member on at least one exterior surface of the developer container portion; and a cap configured to communicate to the suction pump so that the two-component developer is sucked by the suction pump and is conveyed to the developing unit, wherein: the developer containing portion is configured to include an internal space of which at least 12% is an air space measured after the two-component developer is packed in the developer containing portion and left still for at least 24 hours, and wherein:

the two-component developer in the developer containing portion is electrically charged to have an amount of toner charge in a range from approximately −20 mC/g to approximately −30 mC/g.

10. The image forming apparatus according to claim 9, further comprising:

a hopper disposed between the developing unit and the suction pump and configured to reservoir the two-component developer.

11. The image forming apparatus according to claim 9, wherein:

a portion of the developer conveying path includes a tube member formed with a flexible soft material.

12. The image forming apparatus according to claim 11, further comprising:

a hopper disposed between the developing unit and the suction pump and configured to reservoir the two-component developer.

13. A developer container containing a two-component developer including a carrier and toner, the developer container comprising:

means, including a plurality of surfaces, for accommodating the two-component developer, the means for accommodating including a plurality of previously formed folds along which the means for accommodating can be folded, and at least one reinforcing member on at least one exterior surface of the means for accommodating; and means for communicating to a suction pump so that the two-component developer is sucked by the suction pump and is conveyed to a developing unit, wherein: the means for accommodating is configured to include an internal space of which at least 12% is an air space measured after the two-component developer is packed in the means for accommodating and left still for at least 24 hours, and wherein:

the two-component developer in the means for accommodating is electrically charged to have an amount of toner charge in a range from approximately −20 mC/g to approximately −30 mC/g.

* * * * *